US007631604B2

(12) United States Patent
Huang

(10) Patent No.: US 7,631,604 B2
(45) Date of Patent: Dec. 15, 2009

(54) TELESCOPIC AND FOLDABLE TABLE

(76) Inventor: Tsung-Chieh Huang, 235 Chung-Ho Box 8-24, Taipei (TW)

( * ) Notice: Subject to any disclaimer, the term of this patent is extended or adjusted under 35 U.S.C. 154(b) by 544 days.

(21) Appl. No.: 11/429,359

(22) Filed: May 8, 2006

(65) Prior Publication Data

US 2007/0256611 A1 Nov. 8, 2007

(51) Int. Cl.
*A47B 3/02* (2006.01)

(52) U.S. Cl. ..... 108/116; 108/115; 248/166; 248/188

(58) Field of Classification Search ..... 108/162, 108/166, 167, 169, 171, 173, 174, 175, 36, 108/115, 116, 147.19, 133, 125, 129, 131, 108/132, 147.2, 147.22, 143, 137, 117, 120, 108/140, 141; 403/325, 109.3, 109.8, 13; 248/161, 404, 407, 408, 157, 429, 424; 297/DIG. 10, 297/330, 215.14, 215.15, 313, 331, 335, 297/423.12, 423.13, 337
See application file for complete search history.

(56) References Cited

U.S. PATENT DOCUMENTS 1,394,526 A * 10/1921 Amsden ..... 108/5
2,193,647 A * 3/1940 Rush et al. ..... 108/49
2,558,915 A * 7/1951 Sheffer ..... 403/65
2,662,712 A * 12/1953 Rose ..... 248/408
2,719,688 A * 10/1955 Seifert ..... 248/188.5
2,722,970 A * 11/1955 Stechmann ..... 248/188.2
2,833,608 A * 5/1958 Tobias ..... 108/44
2,848,290 A * 8/1958 Doty ..... 108/3
3,640,228 A * 2/1972 Busse ..... 108/6
3,669,392 A * 6/1972 Saunders ..... 248/121
4,328,943 A * 5/1982 Eldon, III ..... 248/578
4,488,497 A * 12/1984 Bevans ..... 108/147.21
4,577,837 A * 3/1986 Berg et al. ..... 254/212
4,640,301 A * 2/1987 Battiston et al. ..... 135/67
4,721,125 A * 1/1988 Wang-Lee ..... 135/69
4,728,065 A * 3/1988 Coote ..... 248/129
4,838,181 A * 6/1989 Luyk ..... 108/156
4,879,954 A * 11/1989 Sawamura et al. ..... 108/6
4,922,836 A * 5/1990 Damico ..... 108/146
RE33,645 E * 7/1991 Coote ..... 248/129
5,131,333 A * 7/1992 Karasawa et al. ..... 108/7
5,144,898 A * 9/1992 Posly ..... 108/148
5,359,741 A * 11/1994 Lang ..... 5/507.1
5,460,392 A * 10/1995 Hansen ..... 280/32.6
5,644,994 A * 7/1997 Liang et al. ..... 108/116
5,702,198 A * 12/1997 Kuo ..... 403/377
5,704,725 A * 1/1998 Horing ..... 403/109.3

(Continued)

*Primary Examiner*—Lanna Mai
*Assistant Examiner*—Salvatore D Zagarella

(57) ABSTRACT

A telescopic and foldable table comprises a table frame having two supporting posts at two sides thereof; each post having a liftable inner tube; each post being installed to a transversal leg at a bottom end thereof; an upper end of the inner tube of the post having a pivotal unit which is pivotally installed to the table plane so that the table plane can pivotally move or transversally displace. By above mentioned components, the table is telescopic and foldable. Each post has a plurality of openings for determining the elevation of the post; each inner tube has a telescopic buckle and a control rod for controlling the telescopic movement of the buckle; and the control rod is controlled by a control unit protruding out of the inner tube. The pivotal unit is pivotally installed to a pivotal seat at a bottom surface of the table plane.

2 Claims, 15 Drawing Sheets

U.S. PATENT DOCUMENTS 5,927,214 A * 7/1999 Schwartz et al. ..... 108/128
6,192,808 B1 * 2/2001 Bue ..... 108/115
6,336,412 B2 * 1/2002 Heimbrock et al. ..... 108/42
6,354,227 B1 * 3/2002 Feldpausch et al. ..... 108/50.11
6,467,747 B1 * 10/2002 Ellsworth ..... 248/548
6,688,634 B2 * 2/2004 Noffsinger ..... 280/651
6,694,891 B1 * 2/2004 Lai ..... 108/6
6,817,303 B2 * 11/2004 Gosselin ..... 108/131
7,086,632 B2 * 8/2006 Hsieh ..... 248/188.1
7,341,006 B2 * 3/2008 Hernandez ..... 108/115
2003/0098559 A1 * 5/2003 Reese ..... 280/32.6
2004/0079845 A1 * 4/2004 Wilcox ..... 248/188.5
2007/0289506 A1 * 12/2007 Branch et al. ..... 108/116
2008/0250988 A1 * 10/2008 Merey ..... 108/124

* cited by examiner

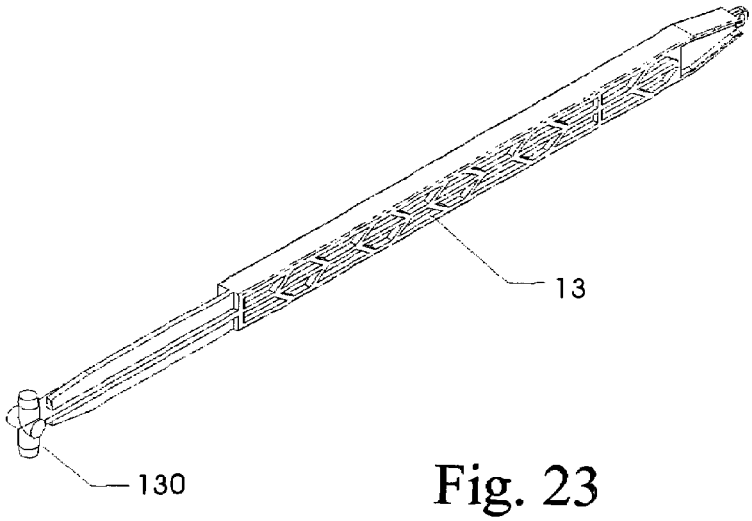
Fig. 23
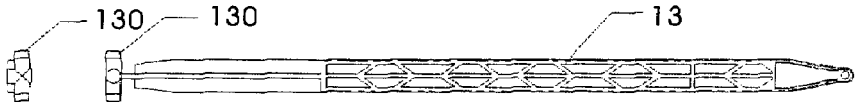
Fig. 25
Fig. 24
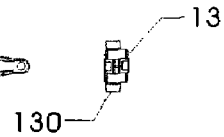
Fig. 26
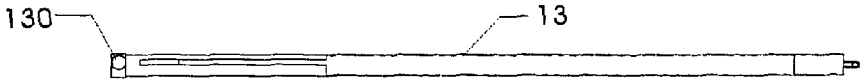
Fig. 27

TELESCOPIC AND FOLDABLE TABLE

FIELD OF THE INVENTION

The present invention relates to tables, and particularly to a telescopic and foldable table, wherein the table has a simple and concrete structure. Furthermore, the folding and expansion operations of the present invention are easily and rapid with a small volume. Thereby the cost in transfer is low.

BACKGROUND OF THE INVENTION

Conventionally, tables used in schools have fixed structures which are un-adjustable. However in school ages, people change their heights continuously and thus the prior art tables are not suitable for the use in schools.

Thereby in one improvement, the school table is modified to have adjustable legs. By adjusting the height of the leg and then locking the legs in the predetermined height, the table is fixed so as to suit the students of various heights. However these kinds of tables have no functions of pivotally moving and displacing the table plates and the legs are unfoldable.

Furthermore, in adjusting the elevation of the table, the table plate must be supported by user's hands and then the screws are detached for adjusting the heights of the legs. The operation is inconvenient and it is not suitable of little boys or girls.

Thereby there is a demand for a novel design which can improve above-mentioned prior art defects.

SUMMARY OF THE INVENTION

Accordingly, the primary object of the present invention is to provide a telescopic and foldable table, wherein table has a simple and concrete structure. Furthermore, the folding and expansion operations of the present invention are easily and rapid with a small volume. Thereby the cost in transfer is low.

To achieve above objects, the present invention provides a telescopic and foldable table which comprises a table frame having two supporting posts at two sides thereof; each post having a liftable inner tube; each post being installed to a transversal leg at a bottom end thereof; an upper end of the inner tube of the post having a pivotal unit which is pivotally installed to the table plane so that the table plane can pivotally move or transversally displace. By above mentioned components, the table is telescopic and foldable. Each post has a plurality of openings for determining the elevation of the post; each inner tube has a telescopic buckle and a control rod for controlling the telescopic movement of the buckle; and the control rod is controlled by a control unit protruding out of the inner tube. The pivotal unit is pivotally installed to a pivotal seat at a bottom surface of the table plane. The pivotal seat is installed to a track at the bottom surface of the table plane; and the pivotal seat is fixed or displace on the track by the controlling of a sliding buckle.

The various objects and advantages of the present invention will be more readily understood from the following detailed description when read in conjunction with the appended drawing.

BRIEF DESCRIPTION OF THE DRAWINGS

FIG. 23 is a perspective view about the control rod of the present invention.

FIG. 24 shows the control rod of the present invention.

FIG. 25 is a left side view of FIG. 24.

FIG. 26 is a right side view of FIG. 24.

FIG. 27 is a bottom view of FIG. 24.

DETAILED DESCRIPTION OF THE INVENTION

Figure 1:
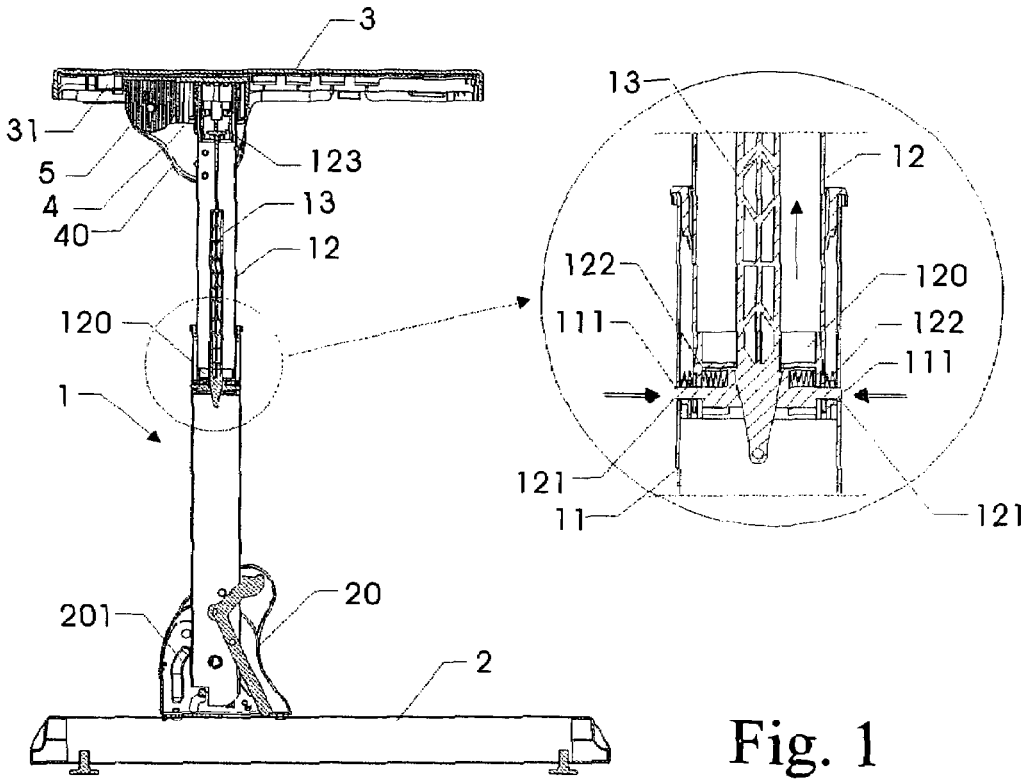
FIG. 1 is a cross sectional view of the embodiment of the present invention.
Figure 2:
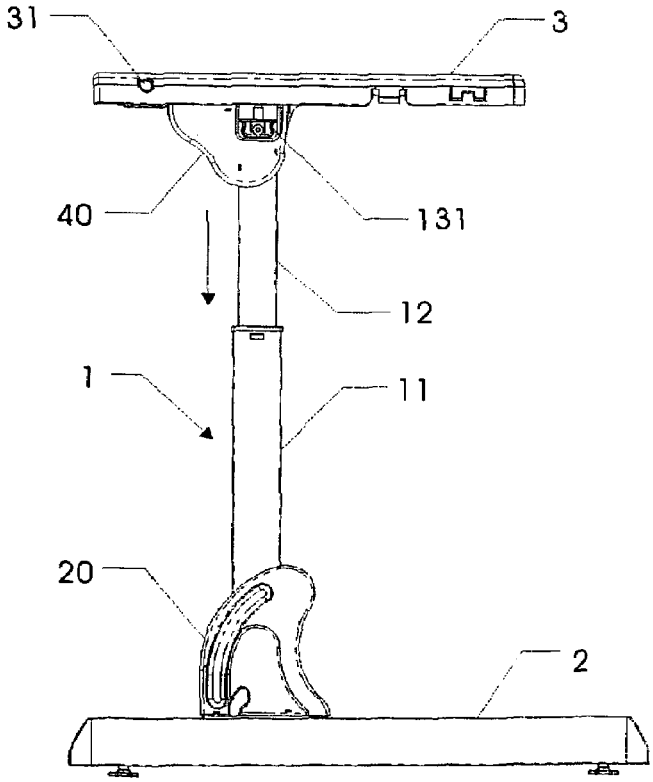
FIG. 2 is a schematic view showing a descending operation of the table plane of the present invention.
Figure 3:
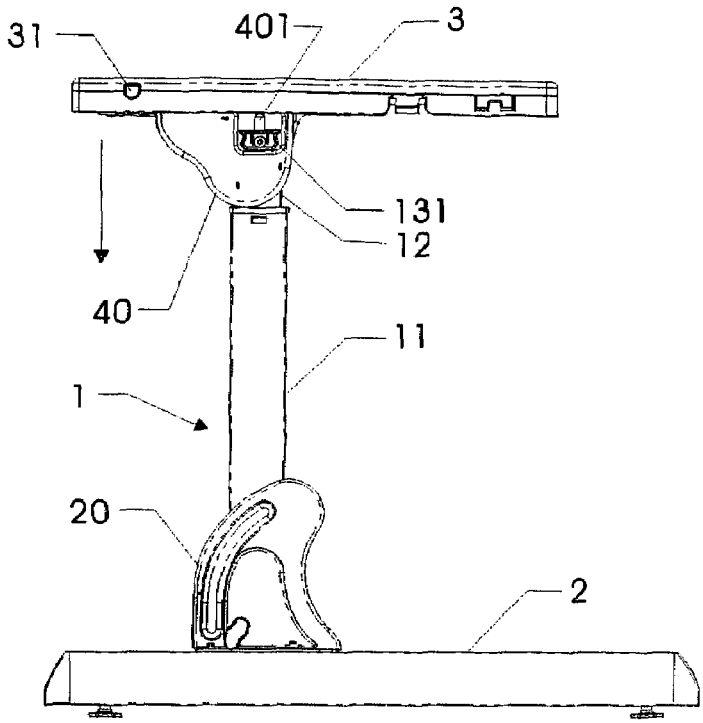
FIG. 3 is a schematic view showing the descending state of the table plane according to the present invention.

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 11, the structure of the present invention is illustrated. The present invention has the following elements.

A table frame 1 has a table plane (3) and two supporting posts 11 at two sides thereof. Each post 11 has a liftable inner tube 12 and an outer tube. Each inner tube 12 has a telescopic buckle 121 (referring to FIGS. 63 to 67) and a control rod 13 (referring to FIGS. 23 to 27) for controlling the telescopic movement of the buckle 121. The control rod 13 is controlled by a control unit 131 (referring to FIGS. 52 to 57) protruding out of the inner tube 12. Each post 11 has a transversal leg 2 at a bottom end thereof. An upper end of the inner tube 12 of the post 11 has a pivotal unit 4 (referring to FIGS. 28 to 33) which is pivotally installed to a pivotal seat 5 (referring to FIGS. 17 to 22) at a bottom surface of the table plane 3. The pivotal seat 5 is installed to a track 30 at the bottom surface of the table plane 3. The pivotal seat 5 may be fixed via a sliding buckle or displaced on the track 30 by the controlling the sliding buckle 31.

Referring to FIG. 1, each outer tube 11 has a plurality of openings 111 for determining the elevation of the post 11. A bottom of each inner tube 12 has a plug 120 (referring to FIGS. 34 to 39). Each buckle is positioned to the telescopic buckle 121. Referring to FIG. 1, the buckle 121 including two portions each is installed with a spring assembly groove each receiving a spring 122. One side of spring 122 resists against an inner wall of the outer tube 11 so that the buckle portions 121 can be reduced inwards toward each other. The control rod 13 is placed between the two springs 122. When the control rod 13 descends to be between the two telescopic buckle portions 121. The two springs 122 compress inwards to make the two buckles 121 protrude from the openings 111 of the post 11 so as to have the effect of buckling and positioning. When the control rod 13 lifts to separate from the two buckles 121, the springs extend so that the two buckles 121 reduce inwards to separate from the openings 111 of the post 11. Thus, the inner tube 12 is liftable and descendable freely. The control rod 13 is assembled to a sliding block 123 illustrated in FIGS. 46 to 51. The sliding block 123 is positioned and installed in the inner tube 12 and is controlled by the control unit 131 protuding out of the inner tube 12. Referring to FIGS. 52 to 57, the control unit 131 is assembled to the sliding block 123 by using a screw to penetrate a long penetrating hole 124 of the inner tube 12. The sliding block 123 is installed with a connecting groove 125 for connecting a buckling head 130 at one end of the control rod 13.

Referring to FIGS. 4 to 6 and 12, each of two sides of the table plane 3 is installed with a sliding buckle 31 and a sliding buckle spring 311 (as shown in FIGS. 40 to 45) and top block 32 and spring 321 (referring to FIGS. 58 to 62). Referring to FIGS. 17 to 22, the pivotal seat 5 is formed with a slot 50 receiving the sliding buckle 31. The top block 32 is displaceable on the table plane 3 by the top block spring 321 and inserted in the spring assembly groove 320. When the top block 32 moves to a predetermined point, it can buckle the slot 50 of the pivotal seat 5. When the sliding buckle 31 is pressed so as to separate from the slot 50 of the pivotal seat 5, the top block 32 will eject the pivotal seat 5 by the elasticity of the spring 321. Thus the table plane 3 is movable.

The pivotal seat 5 is pivotally installed to a pivotal unit 4 at the top end of the inner tube 12. The pivotal seat 5 is fixedly installed to the top end of the inner tube 12 and is shielded by a decorating plate 40. The decorating plate 40 is formed with a long penetrating hole 401 corresponding to the long penetrating hole 124 of the inner tube 12 and a long penetrating hole 41 of the pivotal unit 4 so that the control unit 131 can be assembled to the sliding block 123 in the inner tube 12 to adjust the elevation of the control rod 13.

A transversal bar 10 is installed between the two posts 11 at two sides of the table frame 1. The transversal bar 10 is installed with a supporting rod 101 which transversally extends along the table plane 3 for enhancing the structure of the table plane 3.

A pivotal device 20 is installed at a lower end of each post 11 to pivotally install the leg 2. Each pivotal device 20 has a cambered opening 201. Thereby a treadable bar 21 is placed in the cambered opening 201. Thus, the pivotal device 20 can be positioned no matter whether the legs 2 are folded or expanded. The opening 201 and the bar 21 are known in the prior art and thus the details will not be further described herein.

Figure 4:
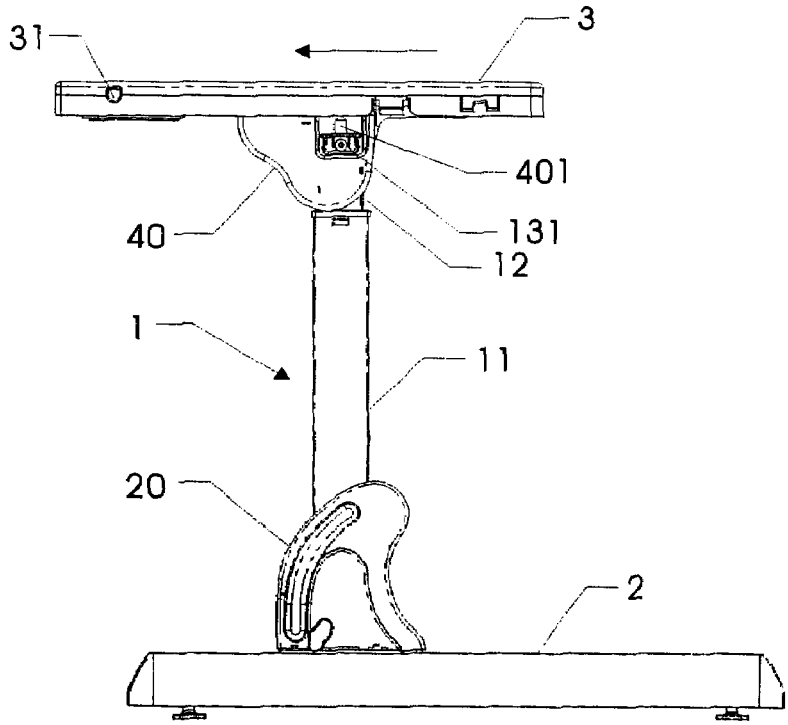
FIG. 4 is a schematic view showing the transversal movement of the table plane of the present invention.
Figure 5:
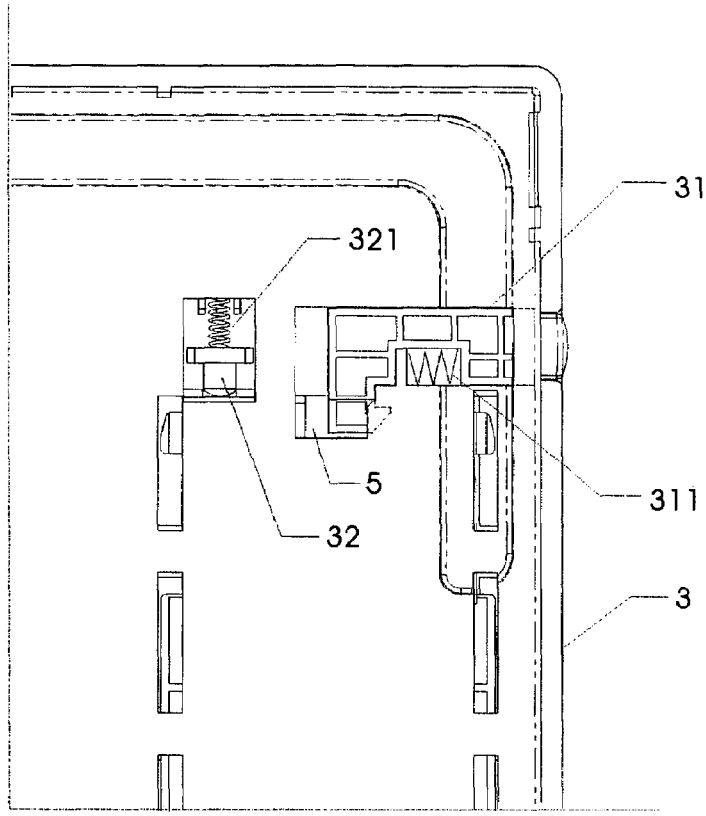
FIG. 5 is a schematic view showing the table plane, sliding buckle, and top block of the present invention.
Figure 6:
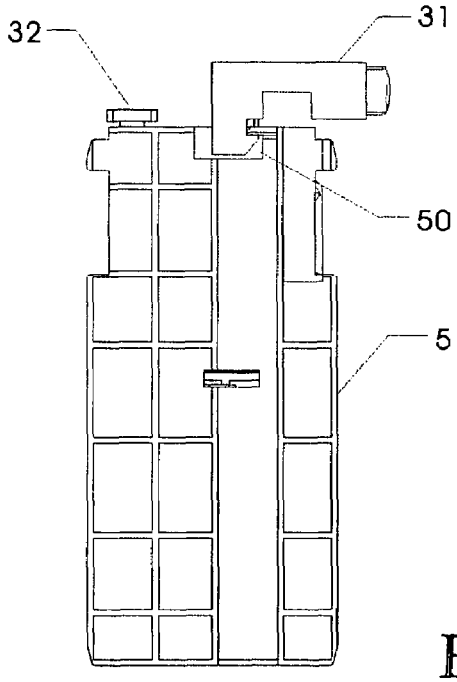
FIG. 6 is a schematic view showing the installation of the pivotal seat and sliding buckle of the present invention.
Figure 7:
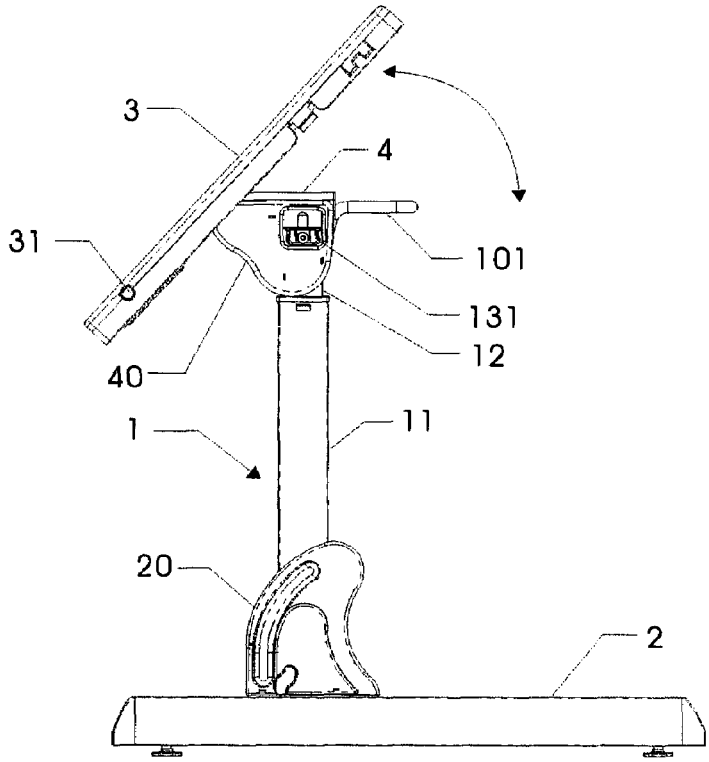
FIG. 7 is a schematic view showing the upward movement of table plane of the present invention.
Figure 8:
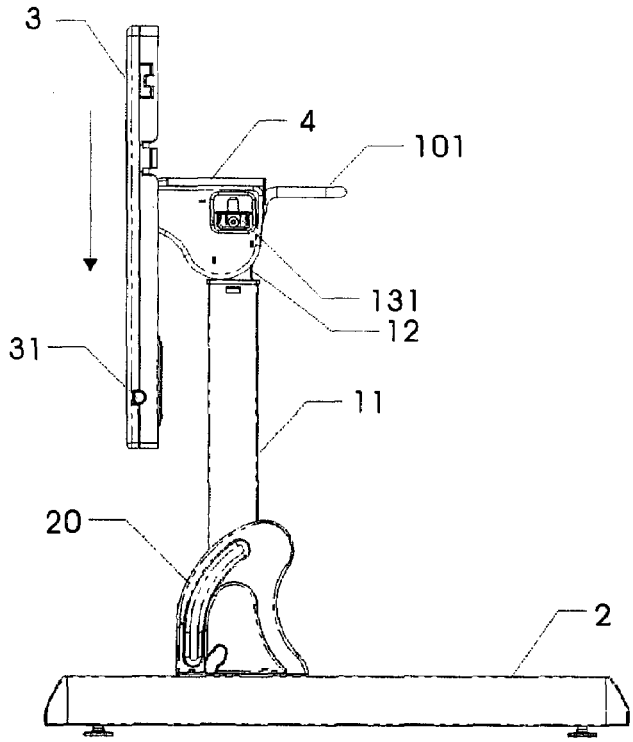
FIG. 8 is a schematic view about the receiving of the table plane of the present invention.
Figure 9:
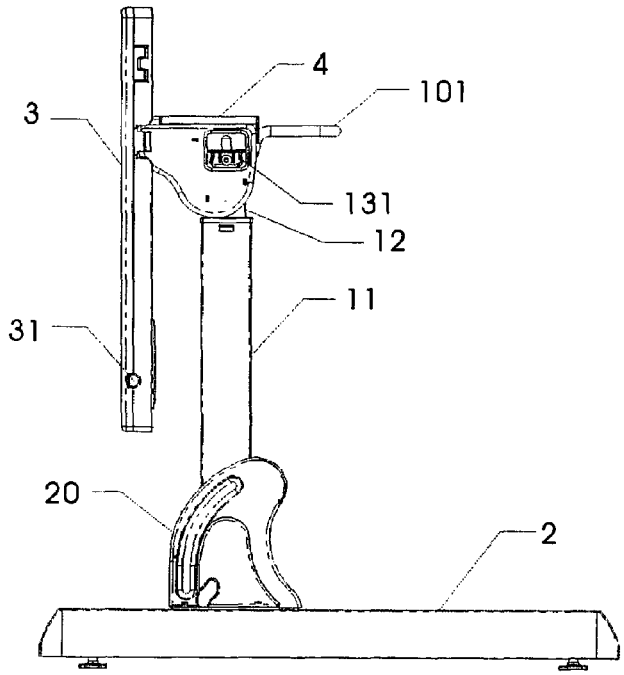
FIG. 9 is a schematic view showing that the table plane is received.
Figure 10:
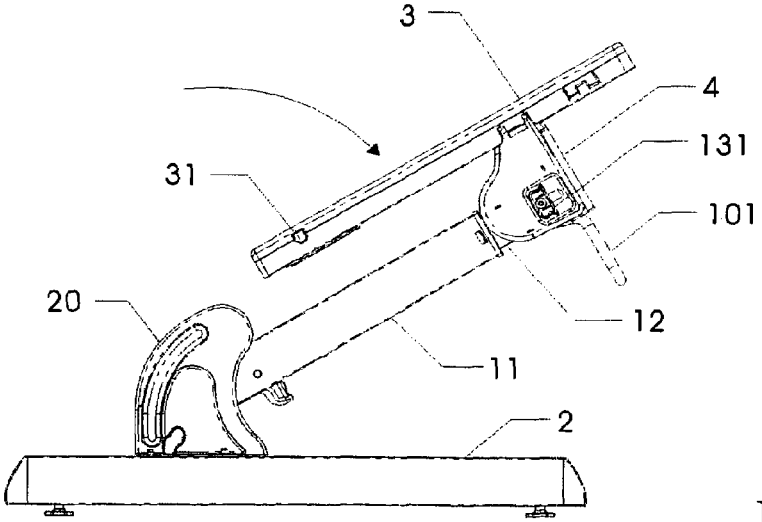
FIG. 10 is a schematic view showing the folding operation of the table leg.
Figure 11:
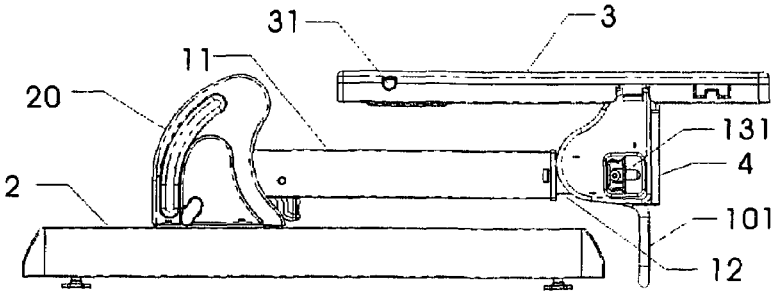
FIG. 11 is a schematic view about the folding of the present invention.
Figure 12:
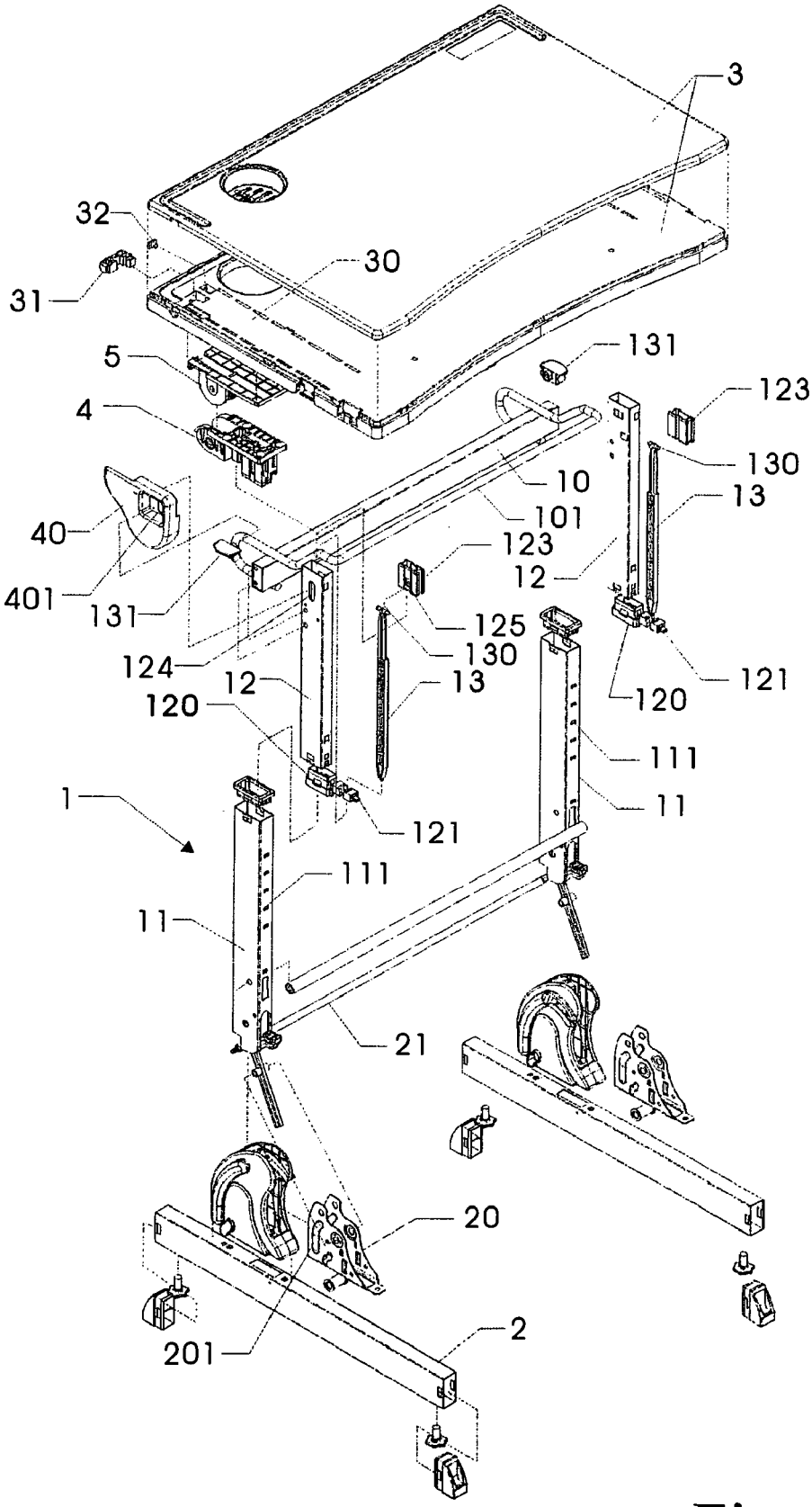
FIG. 12 is an assembled schematic view of the present invention.
Figure 13:
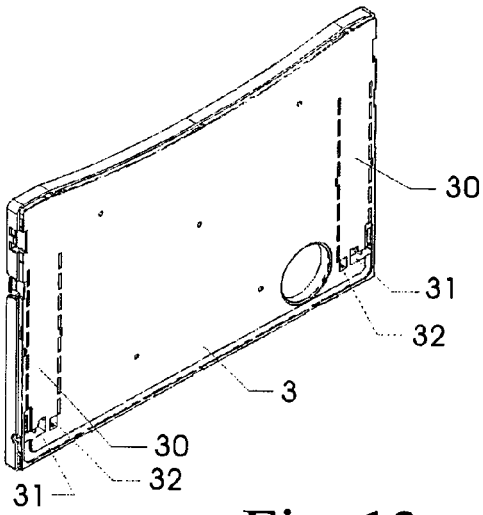
FIG. 13 is a perspective view of the table plane of the present invention.
Figure 16:
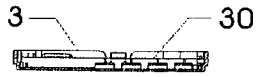
FIG. 16 is a schematic view along line 16-16 of FIG. 14.
Figure 14:
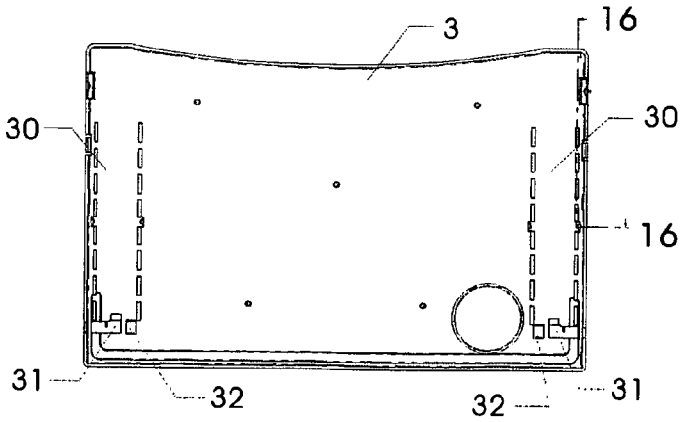
FIG. 14 shows the table plane of the present invention.
Figure 15:
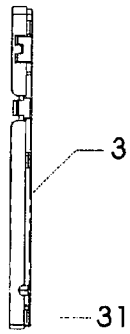
FIG. 15 is a right side view of FIG. 14.
Figure 17:
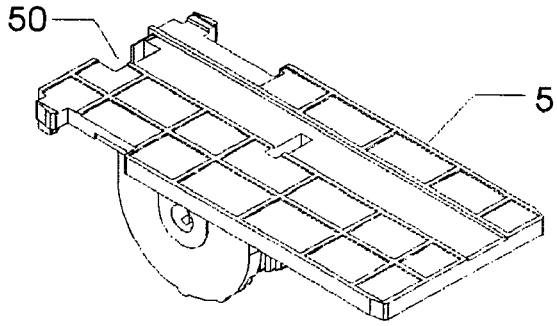
FIG. 17 is a perspective view about the pivotal seat of the present invention.
Figure 21:
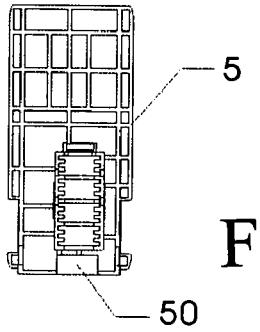
FIG. 21 is an elevation view of FIG. 18.
Figure 19:
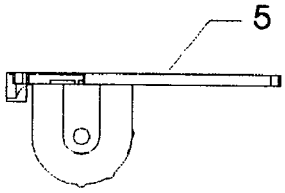
FIG. 19 is a left side view of FIG. 18.
Figure 18:
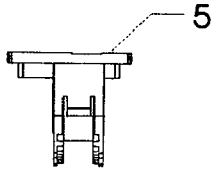
FIG. 18 shows the pivotal seat of the present invention.
Figure 20:
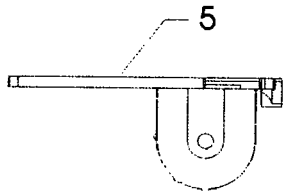
FIG. 20 is a right side view of FIG. 18.
Figure 22:
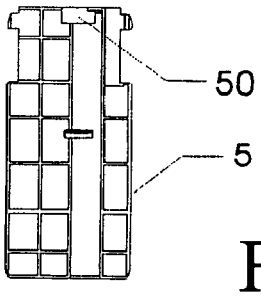
FIG. 22 is a bottom view of FIG. 18.
Figure 28:
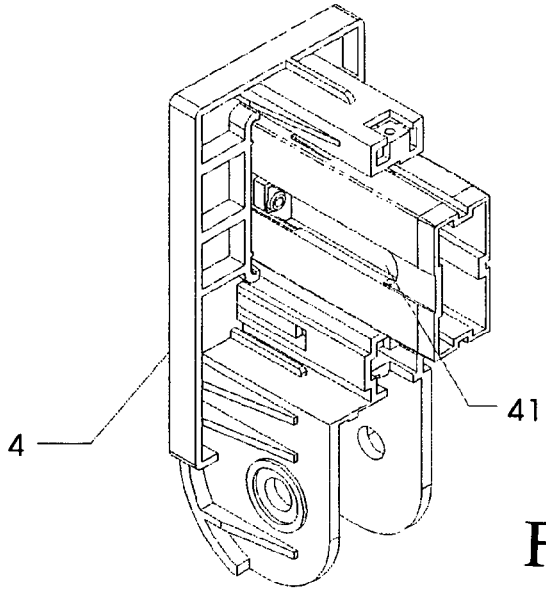
FIG. 28 is a perspective view showing the pivotal unit of the present invention
Figure 32:
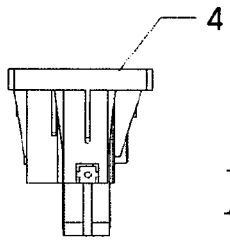
FIG. 32 is an elevational view of FIG. 24.
Figure 30:
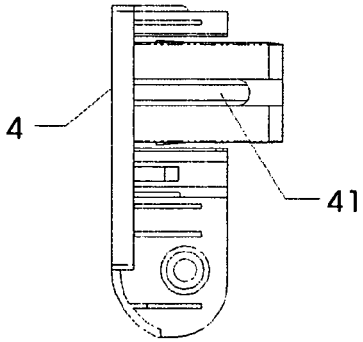
FIG. 30 is a left side view of FIG. 29.
Figure 29:
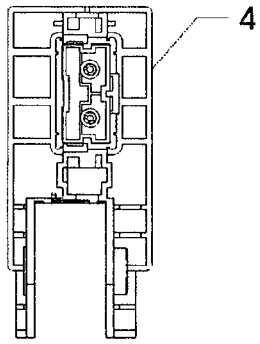
FIG. 29 shows the pivotal unit of the present invention.
Figure 31:
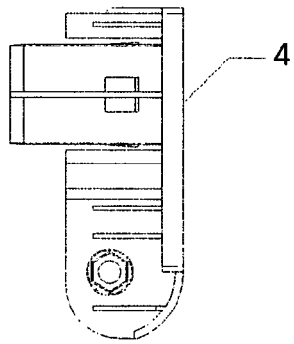
FIG. 31 is a right side view of FIG. 29.
Figure 33:
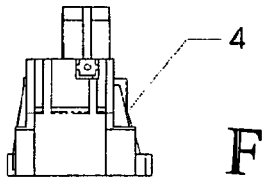
FIG. 33 is a bottom view of FIG. 24.
Figure 34:
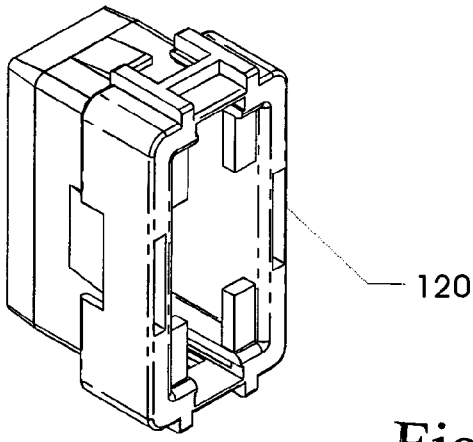
FIG. 34 is a perspective view of the plug of the present invention.
Figure 38:
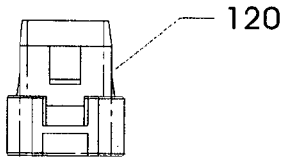
FIG. 38 is an elevational view of FIG. 35.
Figure 36:
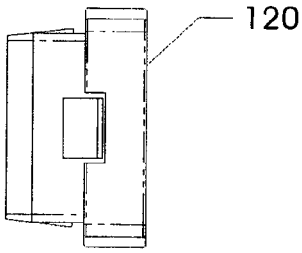
FIG. 36 is a left side view of FIG. 35.
Figure 35:
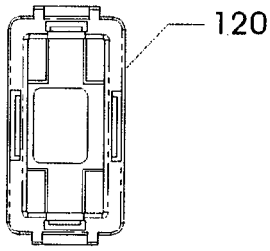
FIG. 35 shows the plug of the present invention.
Figure 37:
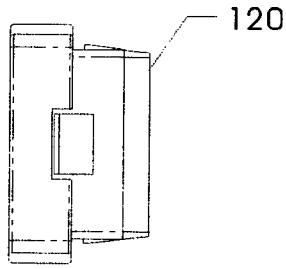
FIG. 37 is a right side view of FIG. 35.
Figure 39:
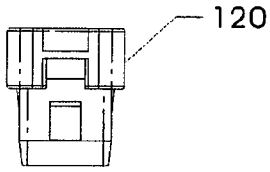
FIG. 39 is a bottom view of FIG. 35.
Figure 40:
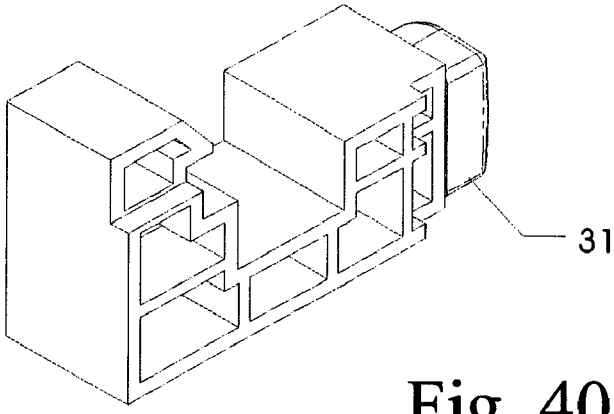
FIG. 40 is a perspective view of the sliding buckle of the present invention.
Figure 44:
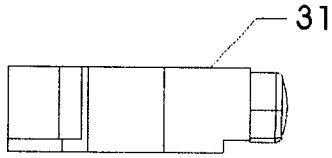
FIG. 44 is an elevational view of FIG. 41.
Figure 42:
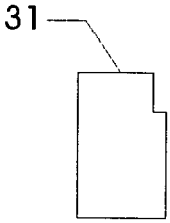
FIG. 42 is a left side view of FIG. 41.
Figure 41:
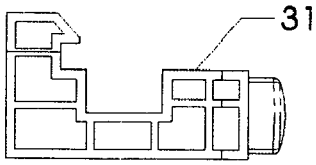
FIG. 41 shows the sliding buckle of the present invention.
Figure 43:
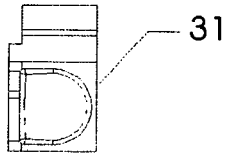
FIG. 43 is a right side view of FIG. 41.
Figure 45:
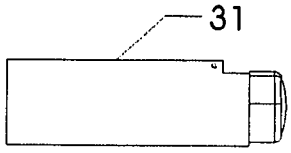
FIG. 45 is a bottom view of FIG. 41.
Figure 46:
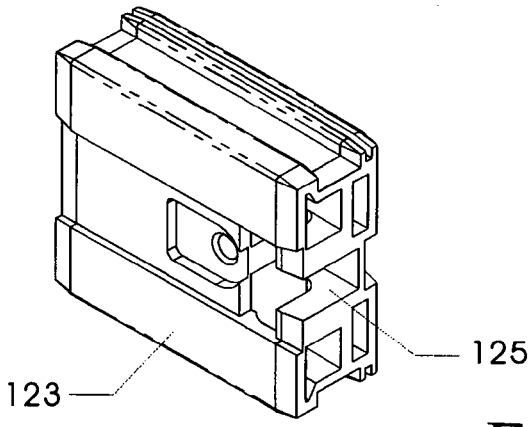
FIG. 46 is a perspective view of the sliding block of the present invention.
Figure 50:
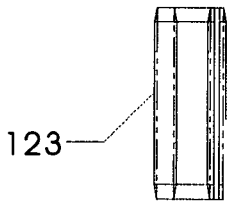
FIG. 50 is an elevational view of FIG. 47.
Figure 48:
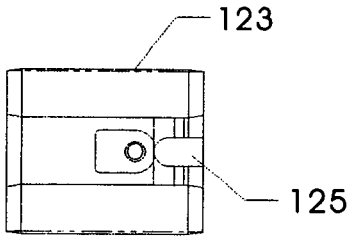
FIG. 48 is a left side view of FIG. 47.
Figure 47:
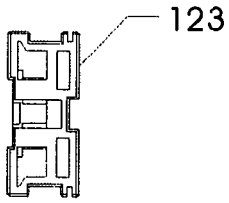
FIG. 47 shows the sliding block of the present invention.
Figure 49:
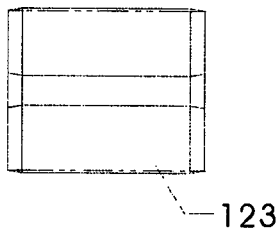
FIG. 49 is a right side view of FIG. 47.
Figure 51:
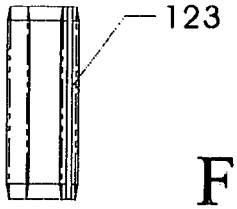
FIG. 51 is a bottom view of FIG. 47.
Figure 52:
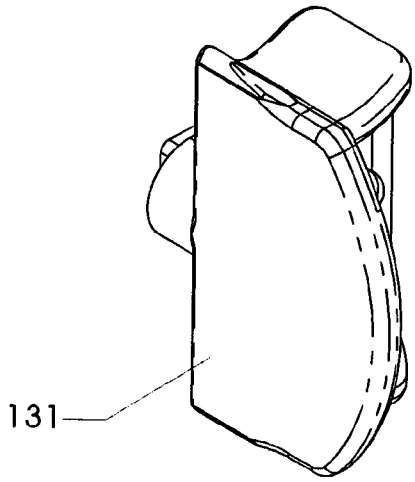
FIG. 52 is a perspective view of the control unit of the present invention.
Figure 56:
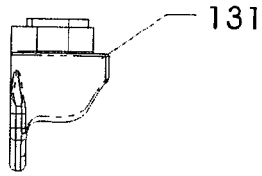
FIG. 56 is an elevational view of FIG. 53.
Figure 54:
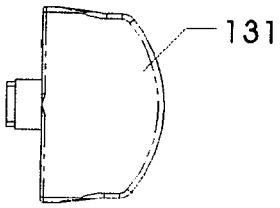
FIG. 54 is a left side view of FIG. 53.
Figure 53:
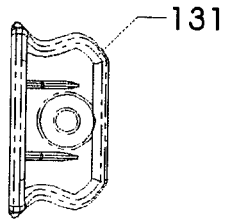
FIG. 53 shows the control unit of the present invention.
Figure 55:
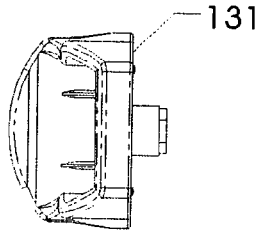
FIG. 55 is a right side view of FIG. 53.
Figure 57:
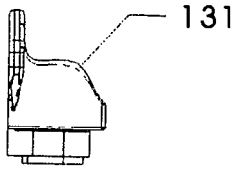
FIG. 57 is a bottom view of FIG. 53.
Figure 58:
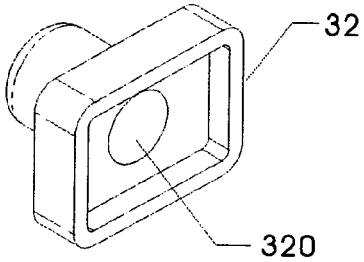
FIG. 58 is a perspective view of the top block of the present invention.
Figure 61:
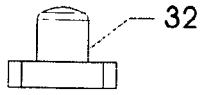
FIG. 61 is a right side view of FIG. 59.
Figure 59:
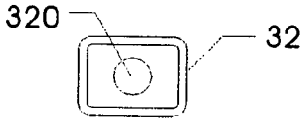
FIG. 59 shows the top block of the present invention.
Figure 60:
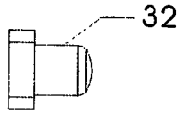
FIG. 60 is a left side view of FIG. 59.
Figure 62:
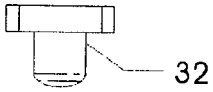
FIG. 62 is an elevational view of FIG. 59.
Figure 63:
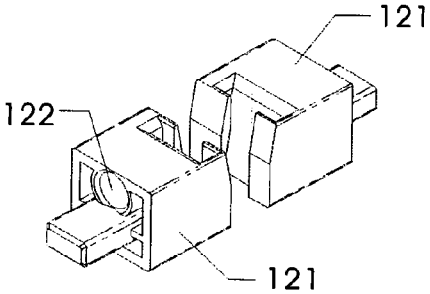
FIG. 63 is a bottom view of FIG. 59.
Figure 67:
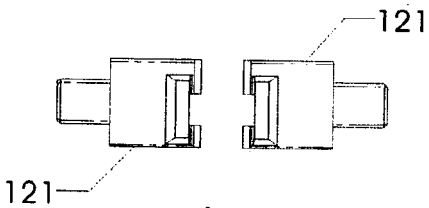
FIG. 67 is a right side view of FIG. 64.
Figure 65:
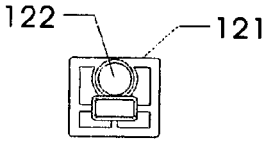
FIG. 65 shows the buckle of the present invention.
Figure 64:
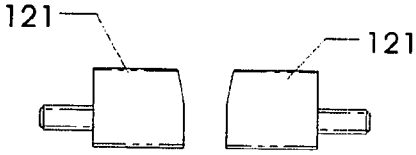
FIG. 64 is a perspective view of the buckle of the present invention.
Figure 66:
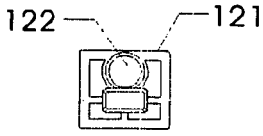
FIG. 66 is a left side view of FIG. 64.

Referring to FIGS. 1 to 11, the operation schematic view of the present invention is illustrated. When it is desired to fold the table, as see in FIGS. 1, the control unit 131 is moved upwards by the hands of the user so that the inner tubes 12 descend to be in the posts 11 of the table frame 1. Then the sliding buckles 31 at two sides of the table plane 3 are pressed so that the pivotal seat 5 is movable with respect to the table plane 3, as shown in FIG. 4. Then the table plane 3 is moved upwards, as shown in FIG. 7. Then the table plane 3 is vertically received, as shown in FIGS. 8 and 9. Finally, the legs 2 are folded, as shown in FIGS. 10 and 11 so that the whole table is in a folded state. The expansion of the table can be operated with a reverse sequence.

Advantages of the present invention will be described herein. The present invention has a simple and concrete structure. Furthermore, the folding and expansion operations of the present invention are easily and rapid with a small volume. Thereby the cost in transfer is low.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A telescopic and foldable table, comprising:

a table frame (1) having a table plane (3) and two supporting posts at two sides thereof; each post (11) having a liftable inner tube (12) and an outer tube; each inner tube (12) having a telescopic buckle (121) and a control rod (13) for controlling the telescopic movement of the buckle (121); the control rod (13) being controlled by a control unit (131) protruding out of the inner tube (12); each post having a transversal leg (2) at a bottom end thereof; an upper end of the inner tube (12) of the post having a pivotal unit (4) being pivotally installed to a pivotal seat (5) at a bottom surface of the table plane (3); the pivotal seat (5) being installed to a track (30) at the bottom surface of the table plane (3); the pivotal seat (5) being fixed via sliding buckle or displaceable on the track (30) by controlling the sliding buckle (31);

each outer tube having a plurality of openings (111) for determining the elevation of the post; a bottom of each inner tube (12) having a plug (120) for positioning the telescopic buckle (121); the telescopic buckle (121) including two portions each being installed with a spring assembly groove each receiving a telescopic buckle spring (122); one side of telescopic buckle spring (122) resisting against an inner wall of the outer tube so that the telescopic buckle portions (121) can be reduced inwards toward each other; the control rod (13) being placed between the two telescopic buckle springs (122); the control rod (13) being assembled to a sliding block (123); the sliding block (123) being positioned and installed in the inner tube (12) and being controlled by the control unit (131) protruding out of the inner tube (12); the control unit (131) being assembled to the sliding block (123) by using a screw to penetrate a long penetrating hole (124) of the inner tube (12); the sliding block (123) being installed with a connecting groove (125) for connecting a buckling head (130) at one end of the control rod (13);

each of two sides of the table plane (3) being installed with the sliding buckle (31) and a sliding buckle spring (311), and a top block (32) and a top block spring (321); the pivotal seat (5) being formed with a slot(50) receiving the sliding buckle (31); the top block (32) being displaceable on the table plane (3) by the spring (321) in the spring assembly groove (320);

the pivotal seat (5) being pivotally installed to a pivotal unit (4) at the top end of the inner tube (12) and being shielded by a decorating plate(40); the decorating plate (40) being formed with a long penetrating hole (401) corresponding to the long penetrating hole (124) of the inner tube (12) and a long penetrating hole (41) of the pivotal unit (4) so that the control unit (131) can be assembled to the sliding block (123) in the inner tube (12) to adjust the elevation of the control rod (13); and a transversal bar (10) being installed between the two posts at two sides of the table frame (1); the transversal bar (10) being installed with a supporting rod (101) which transversally extends along the table plane (3) for enhancing the structure of the table plane (3).

2. The telescopic and foldable table as claimed in claim 1, wherein a pivotal device (20) installed at a lower end of each post to pivotally install the leg (2); each pivotal device (20) having a cambered opening (201).

* * * * *